US011846299B2

(12) United States Patent
Noble et al.

(10) Patent No.: US 11,846,299 B2
(45) Date of Patent: Dec. 19, 2023

(54) FAN

(71) Applicant: Phansee Company, LLC, Charlotte, NC (US)

(72) Inventors: Philip Emanuel Noble, Charlotte, NC (US); Christopher Patrick Noble, Raleigh, NC (US)

(73) Assignee: Phansee Company, LLC, Charlotte, NC (US)

( * ) Notice: Subject to any disclaimer, the term of this patent is extended or adjusted under 35 U.S.C. 154(b) by 0 days.

(21) Appl. No.: 17/186,393

(22) Filed: Feb. 26, 2021

(65) Prior Publication Data

US 2021/0180607 A1 Jun. 17, 2021

Related U.S. Application Data

(63) Continuation-in-part of application No. 16/238,022, filed on Jan. 2, 2019, now Pat. No. 10,935,034.
(Continued)

(51) Int. Cl.

| | |
|---|---|
| ***F04D 25/08*** | (2006.01) |
| ***F04D 29/36*** | (2006.01) |
| ***F04D 29/053*** | (2006.01) |
| ***F04D 29/60*** | (2006.01) |
| ***F04D 27/00*** | (2006.01) |

(Continued)

(52) U.S. Cl.
CPC ..... *F04D 29/36* (2013.01); *F04D 25/088* (2013.01); *F04D 27/00* (2013.01); *F04D 29/002* (2013.01); *F04D 29/053* (2013.01); *F04D 29/34* (2013.01); *F04D 29/362* (2013.01); *F04D 29/601* (2013.01); *F04D 29/646* (2013.01); *F21V 33/0096* (2013.01); *F24F 2221/14* (2013.01)

(58) Field of Classification Search
CPC ..... F04D 27/00; F04D 29/002; F04D 29/088; F04D 29/34; F04D 29/362; F04D 29/601; F04D 29/646; B64C 11/16; B64C 11/30; F03D 7/0224; F24F 2221/14; F21V 33/0096
See application file for complete search history.

(56) References Cited

U.S. PATENT DOCUMENTS 1,815,074 A * 7/1931 Schaefer ..... F21V 21/22 362/404
2,592,315 A 9/1948 Mosley
(Continued)

FOREIGN PATENT DOCUMENTS

CN 201836082 5/2011
CN 202789656 3/2013
(Continued)

*Primary Examiner* — Eldon T Brockman
*Assistant Examiner* — Andrew J Marien
(74) *Attorney, Agent, or Firm* — Trego, Hines & Ladenheim, PLLC; Brandon C. Trego; Jonathan M. Hines

(57) ABSTRACT

A fan is disclosed. The fan includes a base mountable to a ceiling; a base motor contained in the base; a multi-section shaft operably connected to the base motor and moveable between a collapsed position and an extended position; and a fan assembly connected to the multi-section shaft and including a fan motor and at least one fan blade operably connected to the fan motor, wherein in response to a signal, the base motor raises or lowers the fan assembly by moving the multi-section shaft between the collapsed position and the extended position.

16 Claims, 6 Drawing Sheets

Related U.S. Application Data

(60) Provisional application No. 62/612,805, filed on Jan. 2, 2018.

(51) Int. Cl.

| | |
|---|---|
| ***F04D 29/00*** | (2006.01) |
| ***F04D 29/34*** | (2006.01) |
| ***F04D 29/64*** | (2006.01) |
| ***F21V 33/00*** | (2006.01) |

(56) References Cited

U.S. PATENT DOCUMENTS

| | | | | |
|---|---|---|---|---|
| 5,273,402 | A | 12/1993 | Maury | |
| 6,443,702 | B1 * | 9/2002 | Ross | F04D 25/088 416/246 |
| 6,644,928 | B1 | 11/2003 | Tang | |
| 7,179,054 | B1 * | 2/2007 | Borges | F04D 29/362 415/13 |
| 7,726,945 | B2 | 6/2010 | Grant et al. | |
| 8,348,215 | B1 * | 1/2013 | Smith | F04D 25/088 242/390.8 |
| 2004/0253104 | A1 * | 12/2004 | Liu | F04D 29/364 416/48 |
| 2007/0134093 | A1 * | 6/2007 | Weiler | F21V 21/15 416/60 |
| 2008/0037264 | A1 | 2/2008 | Bennett | |
| 2008/0138205 | A1 * | 6/2008 | Cartwright | F04D 25/088 416/244 R |
| 2008/0286105 | A1 * | 11/2008 | Gajewski | F24F 7/007 416/155 |
| 2020/0370441 | A1 * | 11/2020 | Bhosale | F24F 1/38 |

FOREIGN PATENT DOCUMENTS

| | | |
|---|---|---|
| CN | 202946420 | 5/2013 |
| CN | 203702605 | 7/2014 |
| CN | 204984980 | 1/2016 |

* cited by examiner

FAN

BACKGROUND OF THE INVENTION

This invention relates generally to a fan, and more particularly to a ceiling fan designed to allow the fan to be cleaned easily.

Ceiling fans have become standard fixtures in all types of buildings to help circulate air for cooling in the summer and heating in the winter. For example, ceiling fans are often installed in the bedrooms of homes to help circulate air while people sleep at night and the heating and ventilating system is only running intermittently. Likewise, fans are often installed in large buildings to help cool the buildings during the hot summer months.

One of the problems with ceiling fans is that they can often times be difficult to clean due to the height of the ceiling that the fan is mounted to. For example, in some homes fans may be mounted to ceilings with a height of twenty feet. For commercial buildings, the ceilings can be much higher. Thus, cleaning the fan often times results in the need for large ladders and/or extendable poles with cleaning attachments attached thereto.

Accordingly, there is a need for a fan that allows a user to clean the fan without the need for ladders and poles.

BRIEF SUMMARY OF THE INVENTION

This need is addressed by the present invention, which provides a fan capable of being lowered to a cleaning height and that allows a user to rotate the blades so that the user can adequately clean an upper side of the blade.

According to one aspect of the invention, a fan including a base mountable to a ceiling; a base motor contained in the base; a multi-section shaft operably connected to the base motor and moveable between a collapsed position and an extended position; and a fan assembly connected to the multi-section shaft and including a fan motor and at least one fan blade operably connected to the fan motor, wherein in response to a signal, the base motor raises or lowers the fan assembly by moving the multi-section shaft between the collapsed position and the extended position, the fan assembly further including a pitch change mechanism configured to change the pitch of the at least one fan blade, the pitch change mechanism including a first gear rotatable around the fan motor and a second gear meshed with the first gear and operably connected to the fan blade, the first gear driving the second gear such that movement of the second gear causes the at least one fan blade to rotate about a central axis of the at least one fan blade to change the at least one fan blade's pitch.

According to another aspect of the invention, a fan includes a base mountable to a ceiling; a base motor contained in the base; a multi-section shaft moveable between a collapsed position and an extended position, the multi-section shaft being connected to the base motor such that actuation of the base motor causes the multi-section shaft to move between the collapsed position and the extended position; and a fan assembly connected to the multi-section shaft and including a fan motor, at least one fan blade operably connected to the fan motor for rotation, at least one blade mount connected to the at least one fan blade, the at least one blade mount having a fan mount portion for connecting to the at least one fan blade and a motor mount portion for operably connecting the at least one fan blade to the fan motor, the fan assembly further including a pitch change mechanism operably connected to the at least one fan blade to change a pitch of the at least one fan blade, wherein activation of the fan motor causes the at least one fan blade to rotate around a central axis of the multi-section shaft and activation of the pitch change mechanism causes the at least one fan blade to rotate about a central axis of the at least one fan blade to change its pitch.

According to another aspect of the invention, a ceiling fan includes a base mountable to a ceiling; a base motor contained in the base; a multi-section shaft moveable between a collapsed position and an extended position, the multi-section shaft being connected to the base motor such that actuation of the base motor causes the multi-section shaft to move between the collapsed position and the extended position; and a fan assembly connected to the multi-section shaft and including a fan motor, a plurality of fan blades operably connected to the fan motor, and a pitch change mechanism operably connected to each of the plurality of fan blades to change a pitch of each of the plurality of fan blades, the pitch change mechanism including a first gear rotatable around the fan motor and a plurality of second gears meshed with the first gear, each of the plurality of second gears being operably connected to a respective fan blade, the first gear driving each of the plurality of second gears such that movement of each of the second gears causes each of the plurality of fan blades to rotate about a central axis of each of the plurality of fan blades to change each of the plurality of fan blade's pitch.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
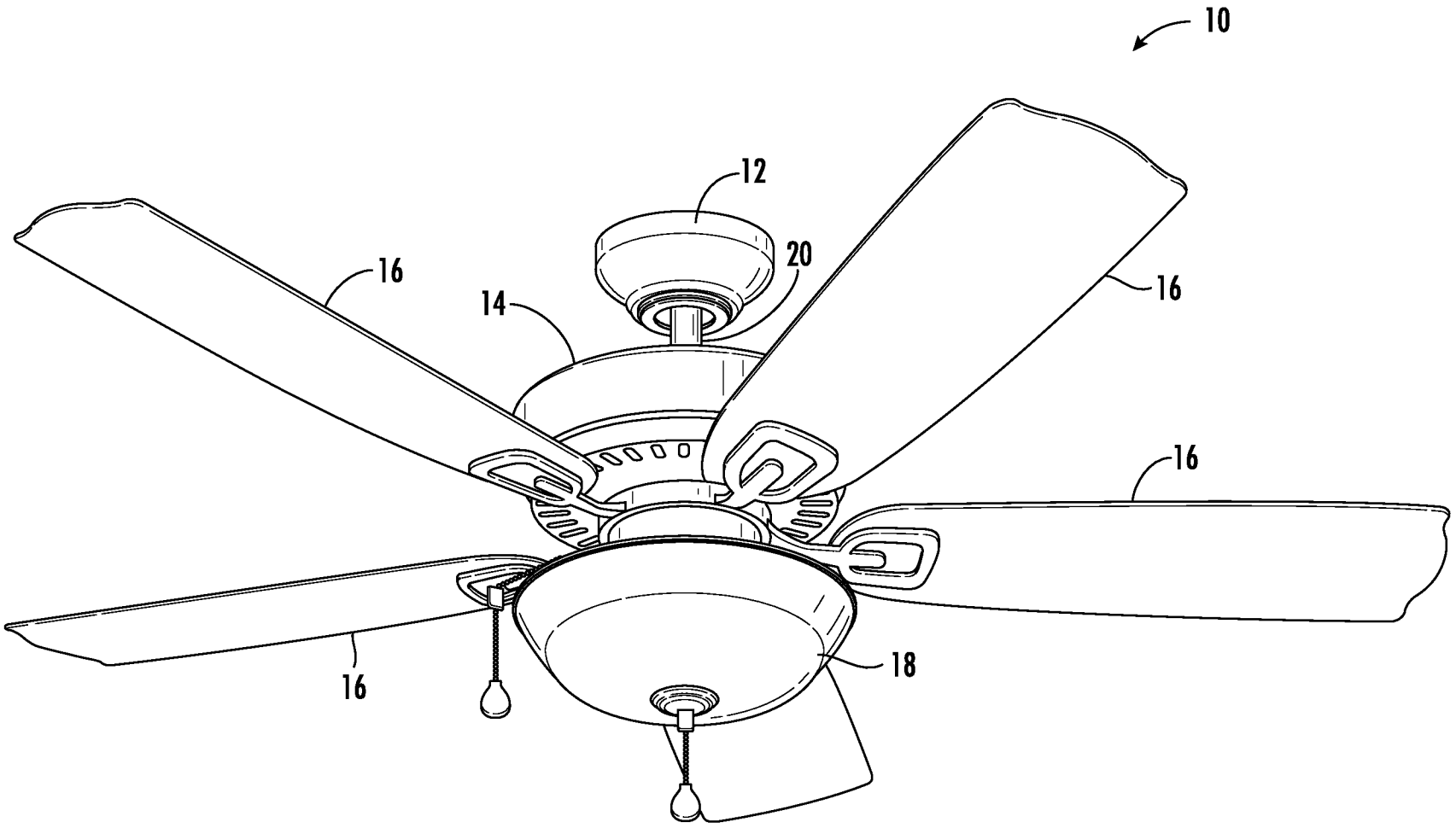
FIG. 1 PRIOR ART
FIG. 1 shows a prior art fan.

Referring to the drawings wherein identical reference numerals denote the same elements throughout the various views, FIG. 1 illustrates a prior art fan 10 having a base 12 to mount the fan to a ceiling, a fan motor 14, a plurality of fan blades 16 connected to the motor 14 and configured for rotation, and a light 18. The fan 10 may also include an extension rod 20 to space the fan blades 16 from the ceiling. It should be understood that the above description is the general description for most ceiling fans currently available and that the invention described below with respect to FIGS. 2 and 3 also includes many of the same pieces and/or parts.

Figure 2:
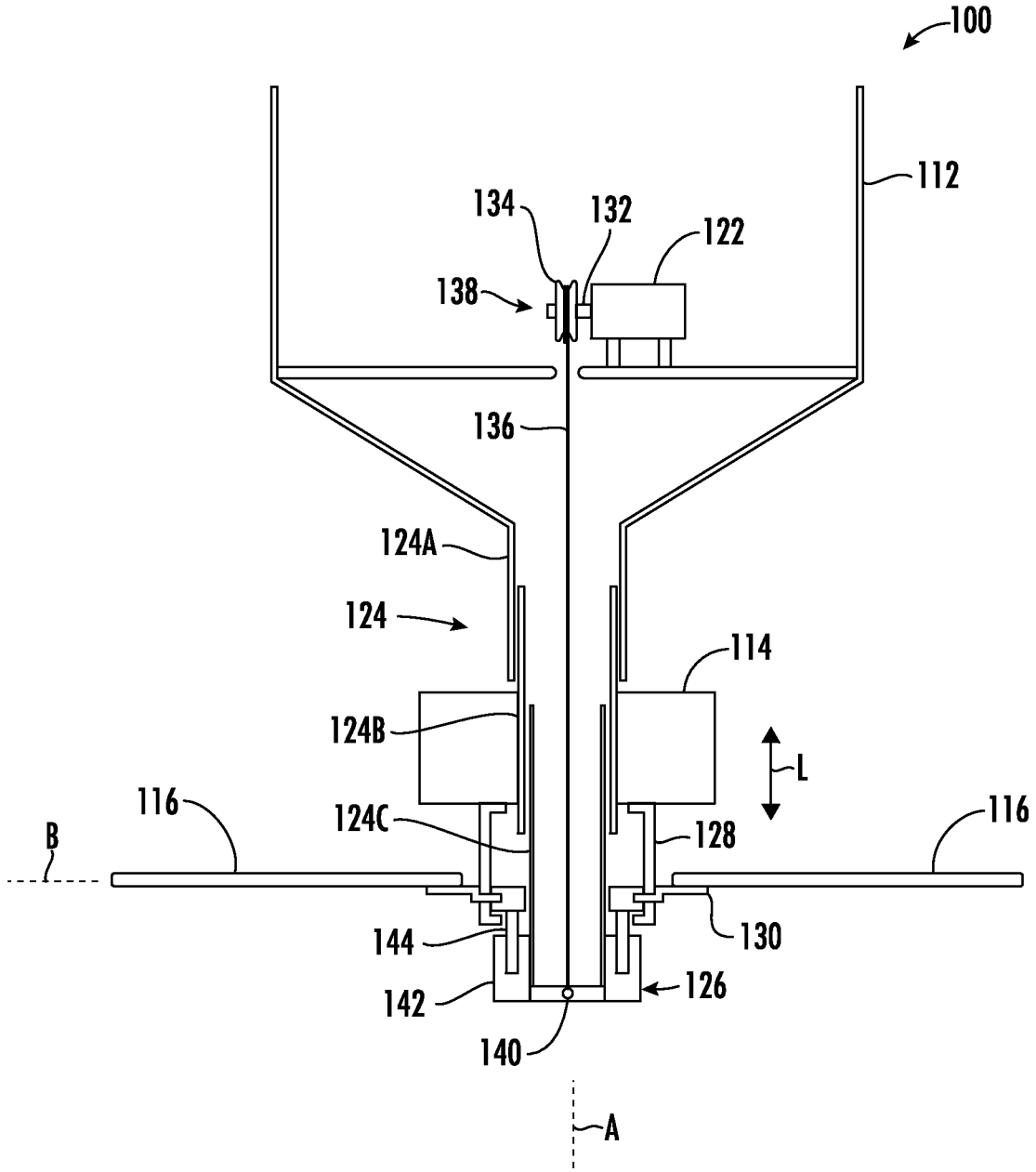
FIG. 2 is a cross-sectional schematic of a fan according to the present invention.
Figure 3:
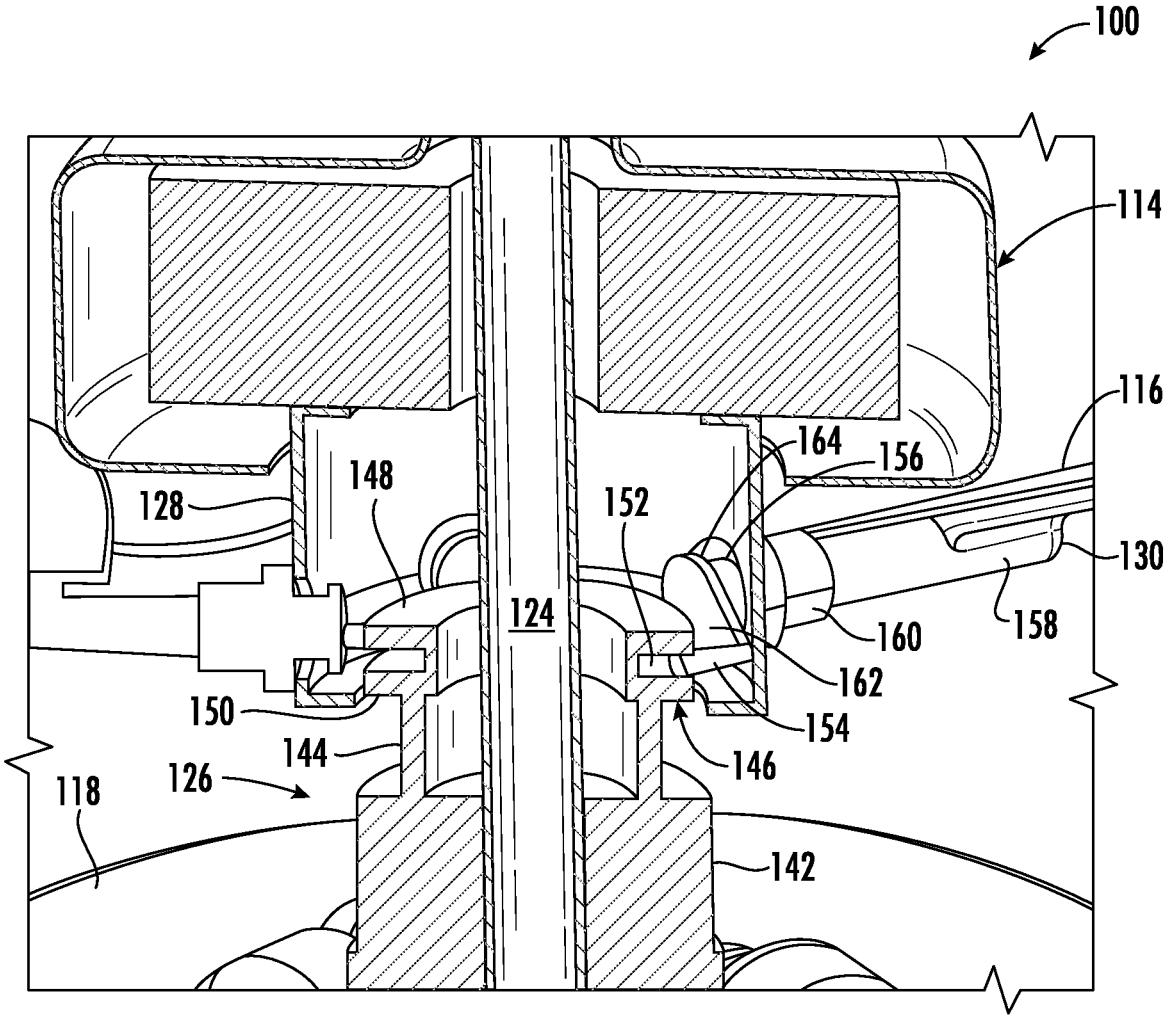
FIG. 3 is a cross-sectional schematic of the fan of the present invention.

Referring now to FIGS. 2 and 3, like fan 10, fan 100 includes a base 112, a fan motor 114, fan blades 116, and a light 118. It should be appreciated that the light 118 is an optional feature and the fan 100 may be used without the light 118. Unlike fan 10, fan 100 includes an electric base motor 122 contained in the base 112, an expandable or extendable multi-section shaft 124, a pitch change mechanism 126, a blade hub 128, and a blade mount 130 for each fan blade 116.

The electric motor 122 is mounted within the base 112 and includes a rotatable shaft 132 connected to the electric motor 122 for rotation and a pulley 134 connected to the shaft 132. A cable 136 is connected to the pulley 134 at a first end 138 and to the multi-section shaft 124 at a second end 140. The cable 136 extends along an interior of the multi-section shaft 124 and is used to raise and lower the motor 114 and fan blades 116. The multi-section shaft 124 includes multiple sections 124A, 124B, and 124C that allow the shaft 124 to extend and collapse. It should be understood that while only three sections are shown, any desired number of sections may be used to increase or shorten the length of travel. This configuration allows a user to lower the fan 100 to a cleaning position and then raise it back up to an operating position.

The pitch change mechanism 126 is positioned along the shaft 124 below the fan blades 116 and includes a solenoid 142 with an electromagnet and a plunger 144 connected thereto. At a first end of the plunger 144, a bearing 146 is formed having an upper ring 148 and a lower ring 150 creating a slot 152 therebetween suitable for receiving a pin 154 of the blade mount 130 therein.

As illustrated, blade mount 130 is connected to a fan blade 116 and extends through an aperture 156 having a bearing surface 164 positioned in the blade hub 128. The blade mount 130 includes fan mount portion 158, a shaft portion 160, and a cam 162 having the pin 154 connected thereto. As illustrated, the pin 154 extends into slot 152. The blade hub 128 may be formed as a single part or as a multi-part hub and is operably connected to the fan motor 114 for rotation; thus, rotation of the blade hub 128 causes the fan blades 116 to rotate about a central axis "A" of the multi-section shaft 124.

In operation, a user can activate electric motor 122 using a remote control or wall switch to lower the fan 100 when cleaning is desired. The remote control may be a user's cellphone via use of an application or a remote provided with the fan 100 and may use short range radio frequency such as Bluetooth, infrared, or any other suitable transmission protocol. Once the fan blades 116 are lowered, the user may clean the fan blades 116.

Additionally, the user may activate the solenoid 142, thereby causing the plunger 144 to move up or down along a length "L" of the multi-section shaft 124. As the plunger 144 moves, the pin 154 moves within the slot 152 causing the cam 162 to rotate and cause the pitch angle of the fan blades 116 to change. In other words, each fan blade 116 rotates about a central axis "B" of the fan blade 116 to change the pitch angle. It should be understood that activation of the solenoid 142 may be accomplished in the same manner as activation of the electric motor 122. Changing the pitch of the fan blades 116 may be done during the cleaning process to allow better cleaning of each fan blade 116 or may be done during operation of the fan 100 to change the amount of air being moved by the fan blades 116.

Figure 4:
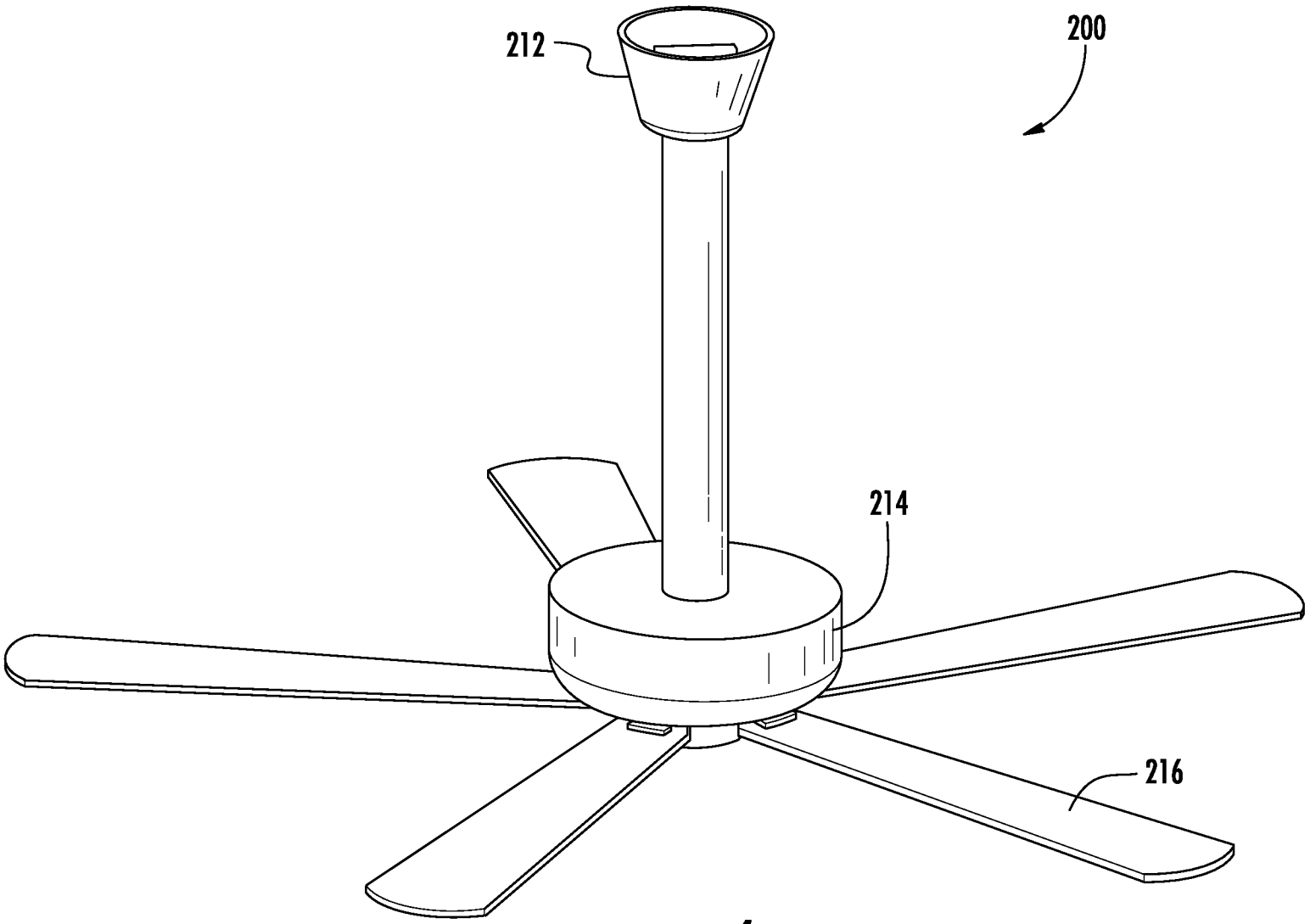
FIG. 4 shows a fan according to the present invention.
Figure 5:
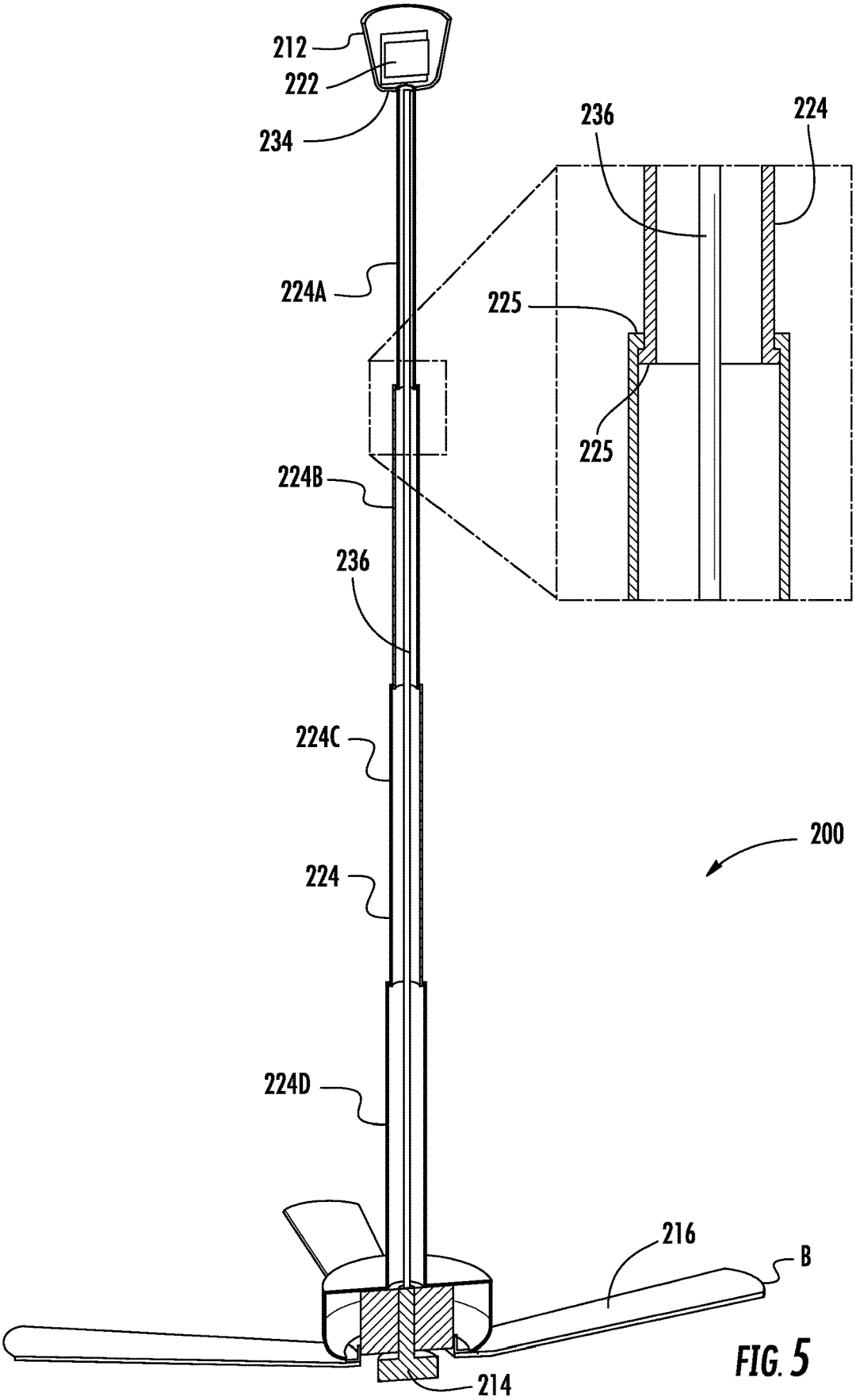
FIG. 5 shows a cross-sectional schematic of the fan of FIG. 4.
Figure 6:
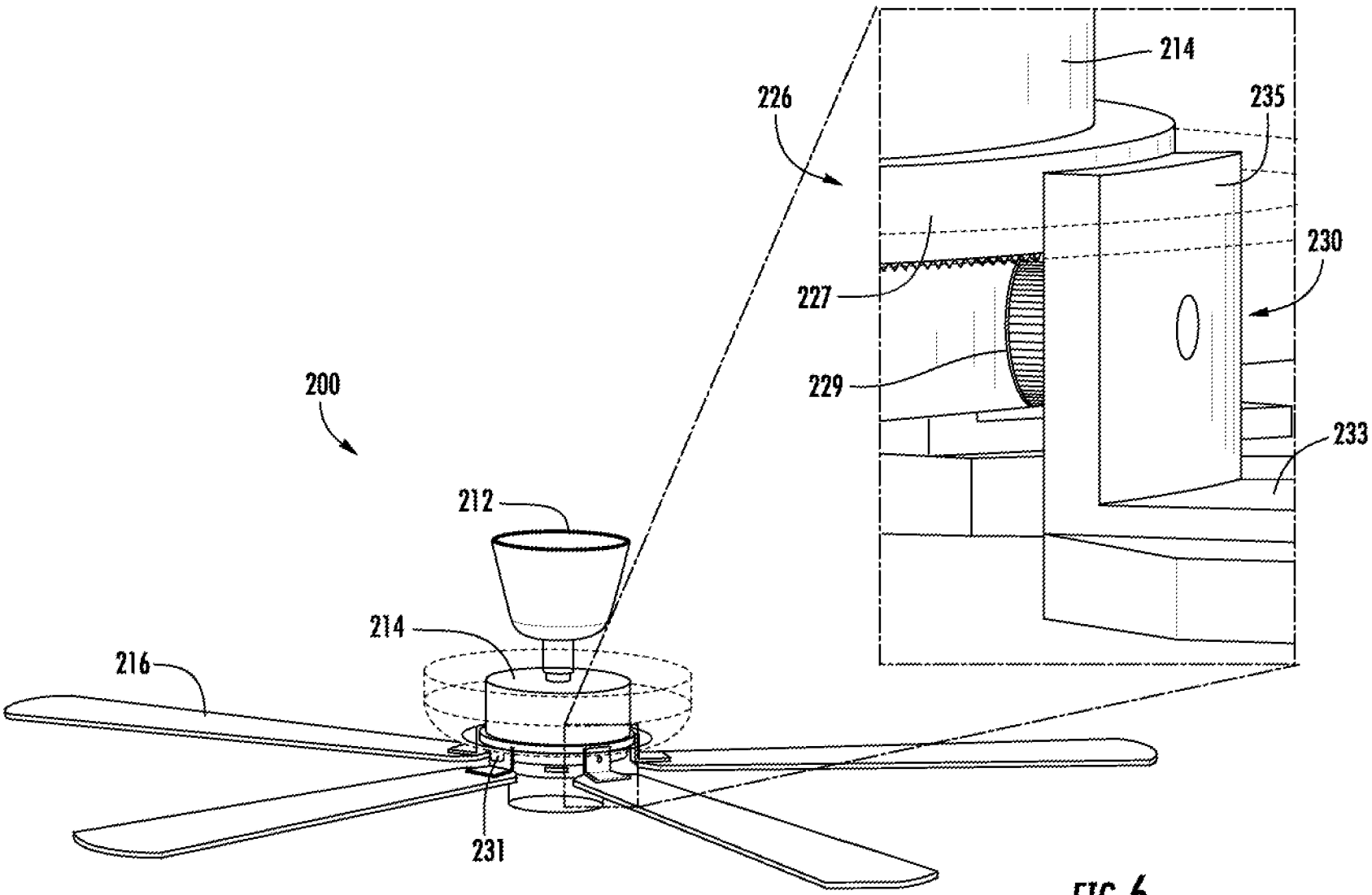
FIG. 6 shows a pitch change mechanism of the fan of FIG. 4.

Referring now to FIGS. 4-6, like fan 100, fan 200 includes a base 212, a fan motor 214, and fan blades 216. Fan 200 may optionally incorporate a light like light 118. Fan 200 includes an electric base motor 222 connected to a winch 234 (the motor 222 and winch 234 contained in the base 212), an expandable or extendable multi-section shaft 224, a pitch change mechanism 226, and a blade mount 230 for each fan blade 216. The blade mount 230 including a fan mount portion 233 connected to a fan blade 216 and a motor mount portion 235 operably connected to the fan motor 214.

The electric motor 222 operates the winch 234. A cable 236 is connected to the winch 234 at a first end 238 and to the fan motor 214 at a second end 240. The cable 236 extends along an interior of the multi-section shaft 224 and is used to raise and lower the motor 214 and fan blades 216. The multi-section shaft 224 includes multiple sections 224A, 224B, 224C, and 224D that allow the shaft 224 to extend and collapse. It should be understood that while only four sections are shown, any desired number of sections may be used to increase or shorten the length of travel. This configuration allows a user to lower the fan 200 to a cleaning position and then raise it back up to an operating position.

As shown in FIG. 5, section 224A has a smaller cross-sectional dimension than section 224D and when extended, section 224A is positioned next to the base 212 and section 224D is positioned next to the fan motor 214. In other words, the shaft sections 224A-224D increase in cross-sectional dimension from the base 212 to the fan motor 214. Such a configuration allows the shaft sections 224A-224D to help support each other. As shown, each of the shaft sections 224A-224D include a lip 225 at each end of the shaft sections 224A-224D. When assembled, the lip 225 of the upper shaft section engages the lip of the lower shaft section such that the upper shaft section supports the lower shaft section.

As illustrated in FIG. 6, the pitch change mechanism 226 includes a ring gear 227 and a mating gear 229 such as a spur gear or other suitable gear. The ring gear 227 is positioned around the fan motor 214 and is designed to rotate 360 degrees thereabout. The ring gear 227 may be driven by any suitable mechanical and/or electrical means. For example, the ring gear 227 may be driven by the rotating fan motor 214. The mating gear 229 is mounted for rotation and is secured to each fan blade mount 230 between the fan motor 214 and blade mount 230 of each fan blade 216. The mating gear 229 is meshed with the ring gear 227 such that rotation of the ring gear 227 causes the mating gear 229 to rotate. A locking mechanism 231 may be installed through an aperture of the blade mount 230 to prevent the fan blades 216 from rotating.

In operation, a user can activate electric motor 222 using a remote control or wall switch to lower the fan 200 when cleaning is desired. The remote control may be a user's cellphone via use of an application or a remote provided with the fan 200 and may use short range radio frequency such as Bluetooth, infrared, or any other suitable transmission protocol. Once the fan blades 216 are lowered, the user may clean the fan blades 216.

Additionally, the user may activate the ring gear 227, causing the mating gear 229 to rotate. Rotation of the mating gear 229 causes the blade mounts 230 and fan blades 216 to rotate and change the pitch angle of the fan blades 216. In other words, each fan blade 216 rotates about a central axis "B" of the fan blade 216 to change the pitch angle. It should be understood that activation of the ring gear 227 may be accomplished in the same manner as activation of the electric motor 222. Changing the pitch of the fan blades 216 may be done during the cleaning process to allow better cleaning of each fan blade 216 or may be done during operation of the fan 200 to change the amount of air being moved by the fan blades 216.

The foregoing has described a fan. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

We claim:

1. A fan, comprising:

a base mountable to a ceiling;

a base motor contained in the base;

a multi-section shaft operably connected to the base motor and moveable between a collapsed position and an extended position; and a fan assembly connected to the multi-section shaft and including a fan motor and at least one fan blade operably connected to the fan motor, wherein in response to a signal, the base motor raises or lowers the fan assembly by moving the multi-section shaft between the collapsed position and the extended position, the fan assembly further including a pitch change mechanism configured to change the pitch of the at least one fan blade, the pitch change mechanism including a first gear surrounding the fan motor and rotatable around the fan motor and a second gear meshed with the first gear and operably connected to the fan blade by a blade mount that has a fan mount portion and a motor mount portion, the first gear driving the second gear such that movement of the second gear causes the at least one fan blade to rotate about a central axis of the at least one fan blade to change the at least one fan blade's pitch.

2. The fan according to claim 1, further including a cable disposed in the multi-section shaft and having a first end connected to the base motor and a second end connected to the fan assembly, wherein actuation of the base motor causes the cable to move the multi-section shaft between the collapsed position and the extended position, thereby raising or lowering the fan assembly.

3. The fan according to claim 1, wherein the fan assembly further includes a locking mechanism adapted to prevent the at least one fan blade from rotating about the central axis, the locking mechanism being installed through an aperture of the blade mount.

4. The fan according to claim 1, wherein the multi-section shaft in the extended position has a smaller cross-sectional diameter near the base than at the fan assembly.

5. The fan according to claim 1, wherein each section of the multi-section shaft includes a lip at each end thereof, the lip adapted to engage a lip of an adjacent section of the multi-section shaft.

6. A fan, comprising:

a base mountable to a ceiling;

a base motor contained in the base;

a multi-section shaft moveable between a collapsed position and an extended position, the multi-section shaft being connected to the base motor such that actuation of the base motor causes the multi-section shaft to move between the collapsed position and the extended position; and a fan assembly connected to the multi-section shaft and including a fan motor, at least one fan blade operably connected to the fan motor for rotation, at least one blade mount connected to the at least one fan blade, the at least one blade mount having a fan mount portion for connecting to the at least one fan blade and a motor mount portion for operably connecting the at least one fan blade to the fan motor, the fan assembly further including a pitch change mechanism operably connected to the at least one fan blade to change a pitch of the at least one fan blade, the pitch change mechanism including a first gear surrounding the fan motor and rotatable around the fan motor and a second gear meshed with the first gear and operably connected to the fan blade by the blade mount, wherein activation of the fan motor causes the at least one fan blade to rotate around a central axis of the multi-section shaft and activation of the pitch change mechanism causes the at least one fan blade to rotate about a central axis of the at least one fan blade to change its pitch.

7. The fan according to claim 6, further including a cable disposed in the multi-section shaft, the cable having a first end connected to the base motor and a second end connected to the fan assembly.

8. The fan according to claim 7, wherein the cable extends along an interior of the multi-section shaft.

9. The fan according to claim 6, wherein the first gear drives the second gear such that movement of the second gear causes the at least one fan blade to rotate about the central axis of the at least one fan blade to change the at least one fan blade's pitch.

10. The fan according to claim 9, wherein the second gear is positioned between the motor mount portion of the blade mount and the fan motor.

11. A ceiling fan, comprising:

a base mountable to a ceiling;

a base motor contained in the base;

a multi-section shaft moveable between a collapsed position and an extended position, the multi-section shaft being connected to the base motor such that actuation of the base motor causes the multi-section shaft to move between the collapsed position and the extended position; and a fan assembly connected to the multi-section shaft and including a fan motor, a plurality of fan blades operably connected to the fan motor, and a pitch change mechanism operably connected to each of the plurality of fan blades to change a pitch of each of the plurality of fan blades, the pitch change mechanism including a first gear surrounding the fan motor and rotatable around the fan motor and a plurality of second gears meshed with the first gear, each of the plurality of second gears being operably connected to a respective fan blade by a blade mount that has a fan mount portion and a blade mount portion, the first gear driving each of the plurality of second gears such that movement of each of the second gears causes each of the plurality of fan blades to rotate about a central axis of each of the plurality of fan blades to change each of the plurality of fan blade's pitch.

12. The ceiling fan according to claim 11, wherein activation of the fan motor causes the plurality of fan blades to rotate around a central axis of the multi-section shaft.

13. The fan according to claim 11, wherein the fan assembly further includes a plurality of locking mechanisms adapted to prevent the plurality of fan blades from rotating about the central axis.

14. The fan according to claim 11, further including a cable disposed in the multi-section shaft and having a first end connected to the base motor and a second end connected to the fan assembly, wherein actuation of the base motor causes the cable to move the multi-section shaft between the collapsed position and the extended position, thereby raising or lowering the fan assembly.

15. The fan according to claim 11, wherein the multi-section shaft in the extended position has a smaller cross-sectional diameter near the base than at the fan assembly.

16. The fan according to claim 11, wherein each section of the multi-section shaft includes a lip at each end thereof, the lip adapted to engage a lip of an adjacent section of the multi-section shaft.

* * * * *